US012241327B1

(12) United States Patent
Kalu-Ulu et al.

(10) Patent No.: US 12,241,327 B1
(45) Date of Patent: Mar. 4, 2025

(54) ADVANCED WELLTRACKER DEPLOYMENT CAPSULE FOR OIL AND GAS WELLS

(71) Applicant: SAUDI ARABIAN OIL COMPANY, Dhahran (SA)

(72) Inventors: Torty Chinenye Kalu-Ulu, Ras Tanura (SA); James Ohioma Arukhe, Dhahran (SA); Ali Naji Alaithan, Umran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/490,389

(22) Filed: Oct. 19, 2023

(51) Int. Cl.

| | |
|---|---|
| ***E21B 23/00*** | (2006.01) |
| ***E21B 23/10*** | (2006.01) |
| ***E21B 33/13*** | (2006.01) |
| ***E21B 34/04*** | (2006.01) |
| ***E21B 43/26*** | (2006.01) |
| ***E21B 47/12*** | (2012.01) |

(52) U.S. Cl.
CPC ..... *E21B 23/10* (2013.01); *E21B 34/04* (2013.01); *E21B 47/138* (2020.05)

(58) Field of Classification Search
None
See application file for complete search history.

(56) References Cited

U.S. PATENT DOCUMENTS

| | | | | |
|---|---|---|---|---|
| 8,136,585 | B2 | 3/2012 | Cherewyk | |
| 9,115,562 | B2 * | 8/2015 | Guidry | E21B 33/068 |
| 9,644,446 | B2 * | 5/2017 | Bihun | E21B 33/068 |
| 10,612,332 | B1 * | 4/2020 | Sage | E21B 33/12 |
| 10,900,351 | B2 | 1/2021 | Deffenbaugh et al. | |
| 11,208,863 | B2 | 12/2021 | Anthony et al. | |
| 11,434,725 | B2 * | 9/2022 | Eitschberger | E21B 23/10 |

(Continued)

OTHER PUBLICATIONS

Aalsalem et al., "Wireless Sensor Networks in oil and gas industry: Recent advances, taxonomy, requirements, and open challenges," Journal of Network and Computer Applications, vol. 113, Jul. 1, 2018, pp. 87-97, 11 pages.

(Continued)

*Primary Examiner* — Matthew R Buck
*Assistant Examiner* — Douglas S Wood
(74) *Attorney, Agent, or Firm* — Osha Bergman Watanabe & Burton LLP

(57) ABSTRACT

A system and method for deploying and retrieving a welltracker in a well include coupling a Christmas tree to the well, coupling a sensor deployment capsule to the Christmas tree, inserting and storing the welltracker into the cylindrical housing via a removable cap screw, and deploying the welltracker through the Christmas tree and into the well. The system and method further include dissolving a dissolvable weight on the welltracker at a well fluid pressure threshold, retrieving the welltracker to the cylindrical housing, bleeding off trapped pressure in the cylindrical housing from retrieval, via the drain valve, through the pressure transfer line, and controlling pressure in the sensor deployment capsule via the pressure gauge. The sensor deployment capsule includes a cylindrical housing including a removable cap screw, a drain valve coupled to the cylindrical housing and a pressure transfer line, and a pressure gauge coupled to the removable cap screw.

20 Claims, 8 Drawing Sheets

(56) References Cited

U.S. PATENT DOCUMENTS

| | | | | |
|---|---|---|---|---|
| 11,454,091 | B2 * | 9/2022 | Jacob | E21B 47/10 |
| 2016/0177673 | A1 * | 6/2016 | Merron | E21B 33/12 166/250.01 |
| 2016/0319625 | A1 | 11/2016 | Conrad et al. | |
| 2016/0320769 | A1 * | 11/2016 | Deffenbaugh | E21B 47/26 |
| 2018/0171739 | A1 * | 6/2018 | Cherewyk | E21B 34/02 |
| 2020/0131899 | A1 | 4/2020 | Chen et al. | |

OTHER PUBLICATIONS

Al-Hajri et al., "The Sensor Ball Revolutionizes Wireline Operations," Society of Petroleum Engineers, SPE-211543-MS, Oct. 31, 2022, 8 pages.

Buzi et al., "Sensor Ball: An Autonomous Untethered Logging Platform," Offshore Technology Conference, OTC-30538-MS, May 4, 2020, 10 pages.

Harper et al., "Advanced Acoustic Telemetry System Provides Real-time Data Acquisition that Increases Efficiency in Well Testing Operations," Offshore Technology Conference, OTC 15324, May 2003, 16 pages.

Kim et al., "Multifunctional Smart Ball Sensor for Wireless Structural Health Monitoring in a Fire Situation," Sensors, Aug. 3, 2020, 13 pages.

Koski, "Deployment Mechanism for Thermal Pointing System," Retrieved from Internet URL: https://ntrs.nasa.gov/api/citations/20150004078/downloads/20150004078.pdf, May 2014, 16 pages.

Liu et al., "Development and prospect of downhole monitoring and data transmission technology for separated zone water injection," Petroleum Exploration and Development, vol. 50, Issue 1, Feb. 2023, pp. 191-201, 11 pages.

Yi et al., "Remote real-time monitoring system for oil and gas well based on wireless sensor networks," Institute of Electrical and Electronics Engineers, Jun. 2010, 3 pages.

Zeghlache et al., "Sensor-Ball: Field Deployment of Autonomous and Untethered Surveillance," International Petroleum Technology Conference, IPTC-22255-MS, Feb. 2022, 14 pages.

* cited by examiner

ADVANCED WELLTRACKER DEPLOYMENT CAPSULE FOR OIL AND GAS WELLS

BACKGROUND

In oil and gas operations, it is common for a welltracker or sensor to be deployed into a well for downhole data acquisition and surveillance. The welltracker is dropped by hand into the well to descend into the wellbore to collect data along the way. A common issue encountered with welltracker deployment is the retrieval of the welltracker back to surface. Specifically, in low pressure wells, there may not be enough pressure to lift the welltracker up to surface using buoyancy.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for deploying and retrieving a welltracker in a well comprising: a Christmas tree coupled to the well comprising a master valve configured to open and close; and a sensor deployment capsule coupled to the Christmas tree, the sensor deployment capsule comprising: a cylindrical housing comprising a removable cap screw for inserting the welltracker in the cylindrical housing, the cylindrical housing configured to store the welltracker when the master valve is closed, wherein the master valve is configured to deploy the welltracker through the Christmas tree and into the well when open, wherein the welltracker comprises a dissolvable weight configured to dissolve at a well fluid pressure threshold for retrieving the welltracker to the cylindrical housing; a drain valve coupled to the cylindrical housing configured to bleed off trapped pressure in the cylindrical housing from retrieval of the welltracker through a pressure transfer line coupled to the drain valve; and a pressure gauge coupled to the removable cap screw configured to control pressure in the sensor deployment capsule.

In one aspect, embodiments disclosed herein relate to a method for deploying and retrieving a welltracker in a well comprising: coupling a Christmas tree to the well comprising a master valve configured to open and close; coupling a sensor deployment capsule to the Christmas tree, the sensor deployment capsule comprising: a cylindrical housing comprising a removable cap screw; a drain valve coupled to the cylindrical housing and a pressure transfer line; and a pressure gauge coupled to the removable cap screw; inserting and storing the welltracker into the cylindrical housing via the removable cap screw, wherein storing the welltracker comprises closing the master valve; deploying the welltracker through the Christmas tree and into the well by opening the master valve; dissolving a dissolvable weight on the welltracker at a well fluid pressure threshold; retrieving the welltracker to the cylindrical housing when the dissolvable weight is dissolved; bleeding off trapped pressure in the cylindrical housing from retrieval, via the drain valve, through the pressure transfer line; and controlling pressure in the sensor deployment capsule via the pressure gauge.

Other aspects and advantages of the claimed subject matter will be apparent from the following description and the appended claims.

DETAILED DESCRIPTION

Figure 1:
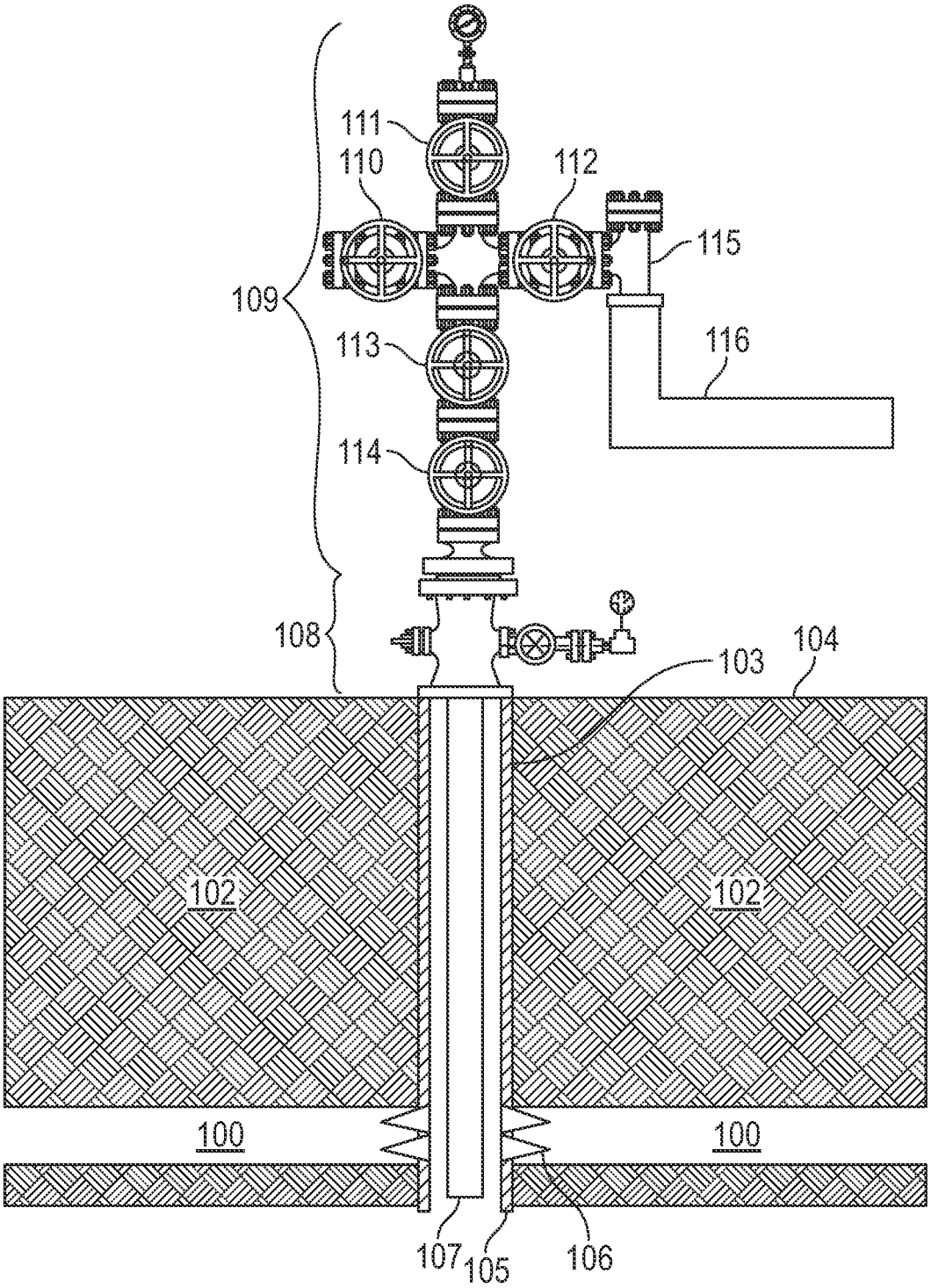
FIG. 1 shows a well system with a Christmas tree in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a force applicator" includes reference to one or more of such force applicators.

In one aspect, embodiments disclosed herein relate to a sensor deployment capsule. The sensor deployment capsule is designed to safely deploy one or more sensors for downhole data acquisition and surveillance in oil and gas wells. The sensor deployment capsule may be used to deploy and retrieve a welltracker to and from a well, regardless of type of well. The sensor deployment capsule optimizes data acquisition and surveillance in wells by eliminating the need for complex wireline or slickline operations, thereby reducing logistical requirements and time associated with data acquisition.

Embodiments of the present disclosure may provide at least one of the following advantages. The sensor deployment capsule may provide advantages such as enhancing wellhead integration, improving wellbore accessibility, enhancing durability, and advancing safety integration. These advantages may provide more detailed insights, access to previously inaccessible areas, longer operational life, resilience to harsh conditions, and seamless integration with existing systems. The sensor deployment capsule may aid in collecting high-resolution data, improving overall operational efficiency, and optimizing well management.

FIG. 1 shows a system in accordance with one or more embodiments. Fluids produced from a hydrocarbon reservoir may include natural gas, oil, and water. In the oil and gas industry, as illustrated in FIG. 1, the fluids are produced from a reservoir (100) in a formation (102) by drilling a wellbore (103) (also referred to as "well") into the formation (102), establishing a flow path between the reservoir (100) and the wellbore (103), and conveying the fluids from the reservoir (100) to a surface (104) through the wellbore (103). A casing (105) may be installed in wellbore (103). In some embodiments, the casing (105) may be perforated to have perforations (106) into the reservoir (100) to allow a flow of the fluids to enter the wellbore (103). Typically, a production tubing (107) is disposed in the wellbore (103) to carry the fluids to the surface (104). The production tubing (107) hangs from a wellhead (108) at the surface (104). The production tubing (107) extends past the reservoir (100), thereby forming a flow conduit from the reservoir (100) to surface (104).

A tree structure, also known as a "Christmas tree" (109), is disposed on top of the wellhead (108) to control the flow of fluids into or out of the wellbore (103), depending on whether it is an injection well or a production well. The Christmas tree (109) includes a configuration of valves to control the fluids being injected into or pumped out of the wellbore (103). For example, the Christmas tree (109) may have an injection wing valve (110), a swab valve (111), a production wing valve (112), an upper master valve (113), and a lower master valve (114).

When an operator is ready to conduct well operations the valves (110, 111, 112, 113, 114) are either opened or closed to control the fluids being injected into or pumped out of the wellbore (103). During injection, the production wing valve (112) and the swab valve (111) are closed while the injection wing valve (110), the upper master valve (113), and the lower master valve (114) are open to allow for fluids to be injected through the Christmas tree (109) and into the wellbore (103). The wellbore (103) may include any well completion design, such as vertical, deviated, or varied orientation. During production, the injection wing valve (110) and the swab valve (111) are closed while the production wing valve (112), the upper master valve (113), and the lower master valve (114) are open to control or isolate fluid flow through a choke valve (115). From the choke valve (115), the fluids are transported, via a production flow line (116), to a production storage, transport, or facility.

The choke valve (115) is a mechanical device to control flow rates and pressure drops of the produced fluids. For example, an operational function of the choke valve (115) is to produce the fluids from the wellbore (103) at the desired rates by the introduction of human intervention to manually control the drawdown pressure. A choke size of the choke valve (115) is changeable to allow for the operator to adjust the amount of pressure dropped across the choke valve (115) in order to maintain a downstream pressure in the production flow line (116) at the desirable value which will lead to achieving the desirable rate.

Figure 2:
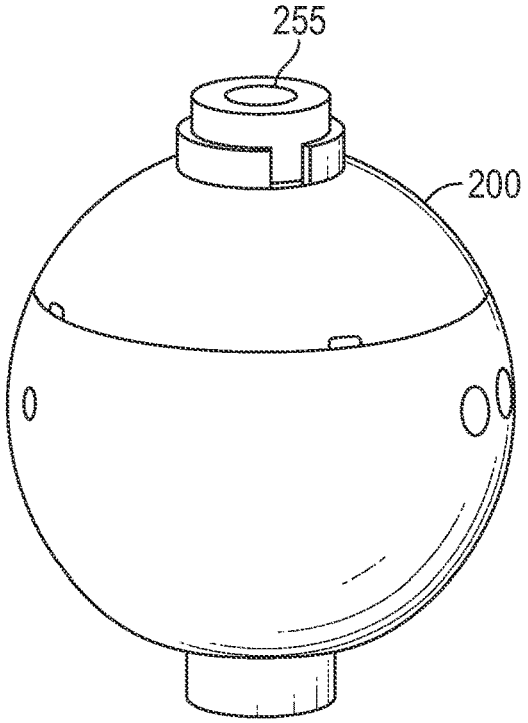
FIGS. 2 and 3 show a welltracker in accordance with one or more embodiments.
Figure 3:
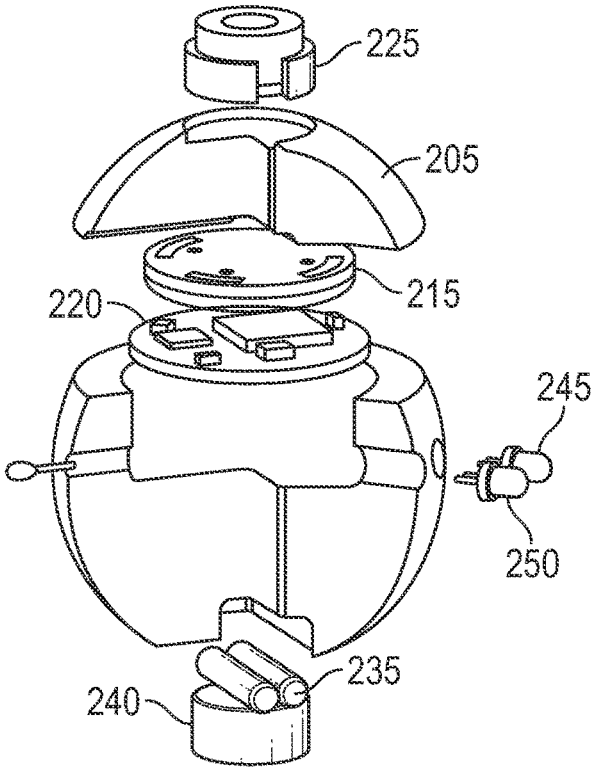

Turning to FIGS. 2 and 3, FIGS. 2 and 3 show a welltracker (200) in accordance with one or more embodiments. Specifically, FIG. 2 shows the welltracker (200) assembled. FIG. 3 illustrates the welltracker (200) deconstructed to show components of the welltracker (200). The welltracker (200) may be deployed into the system described in FIG. 1. The welltracker (200) may be any sensor capable of measuring parameter data or well data such as pressure, temperature, and triaxial magnetic field data. The welltracker (200) may be of a ball shape, as illustrated in FIGS. 2 and 3. The welltracker (200) may include downhole autonomous sensors (225). The sensors (225) may measure properties of fluid in a well and parameter data.

The welltracker (200) may include a housing (205) made of syntactic foam for providing sufficient buoyancy for the welltracker (200) to ascend in a well. The welltracker (200) may further include an internal battery (215) and control and data logging electronics (220). The internal battery (215) may operate the sensor (225). The internal battery (215) may allow the welltracker (200) to operate autonomously without the need for external power sources or physical connections. The internal battery (215) and control and data logging electronics (220) may be surrounded by a liquid or compliant potting material. The inner cavity of the housing (205) may be filled with a non-conductive liquid, such as mineral or castor oil. The inner cavity of the housing (205) may be made of a non-conductive compliant solid, such as silicone rubber.

The welltracker (200) includes a dissolvable weight (240). The dissolvable weight (240) may be magnetically attached to the welltracker (200) via a magnet (235). The magnet (235) may be used to change the buoyancy of the welltracker (200). For example, the dissolvable weight (240) guides or navigates the welltracker (200) to a target well depth. Once the target well depth is reached or a well fluid pressure threshold is reached, polarity of the magnet (235) is reversed by an electrical signal from the control electronics (220). The magnet (235) is released from the welltracker (200) and the dissolvable weight (240) along with the magnet (235). The welltracker (200) may then return to surface. Alternatively, the dissolvable weight (240) may be made of dissolvable material to be dissolved or released based on pre-determined criteria, such as time, pressure, or temperature. The dissolution rate of the dissolvable weight (240) may be controlled. Once the dissolvable weight (240) begins to dissolve, buoyant force increases enabling the welltracker (200) to rise towards the surface. Well data acquired by the welltracker (200) may be downloaded and received using a light emitting diode (245) and a phototransistor (250) in the welltracker (200). The welltracker (200) may further include an eye (255) to be used for connecting tools to the welltracker (200) if necessary. The welltracker (200) may navigate through complex wellbore geometries, including deviated or horizontal sections, multiple branches, and various completion configurations.

The welltracker (200) is commonly deployed and retrieved by hand in water wells with the Christmas tree (109) open. In one or more embodiments, the welltracker (200) is capable of also being deployed and retrieved in oil and gas wells with challenging well conditions by using a sensor deployment capsule (400), further described below in FIGS. 4-8.

Figure 4A:
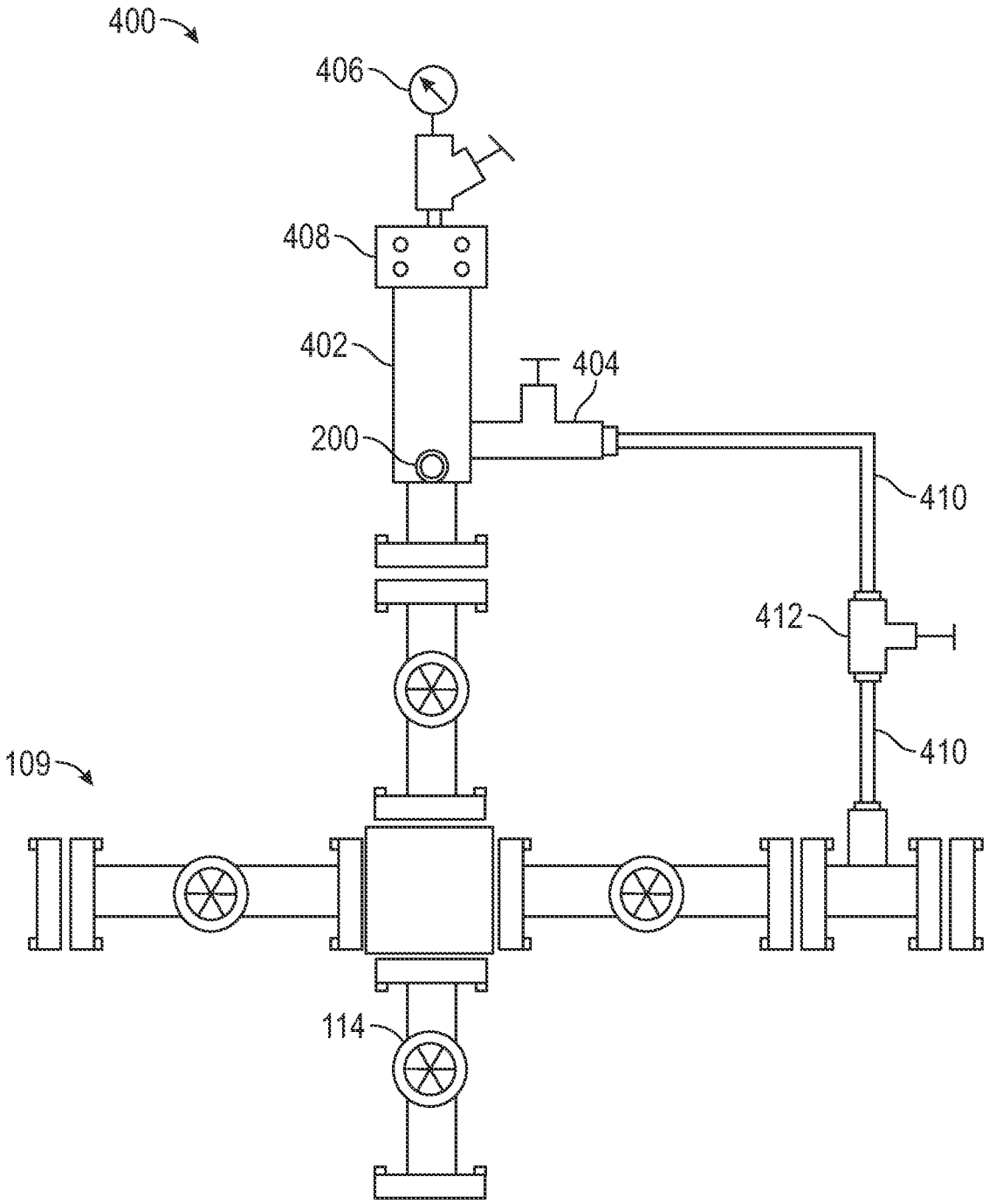
FIGS. 4A-4C show a sensor deployment capsule used in conjunction with FIGS. 1-3 in accordance with one or more embodiments.
Figure 4B:
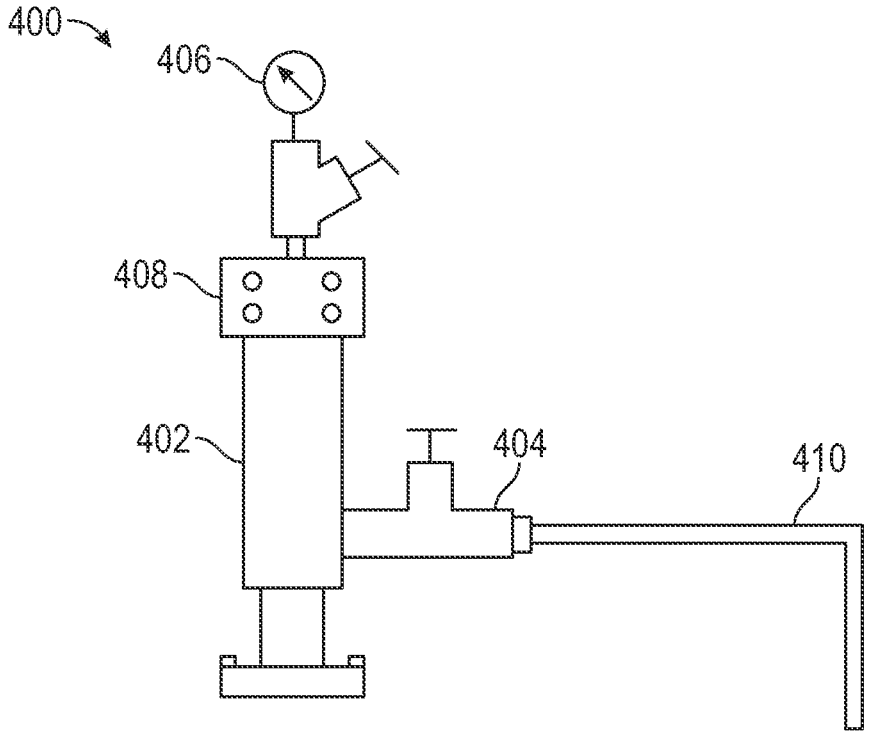
Figure 4C:
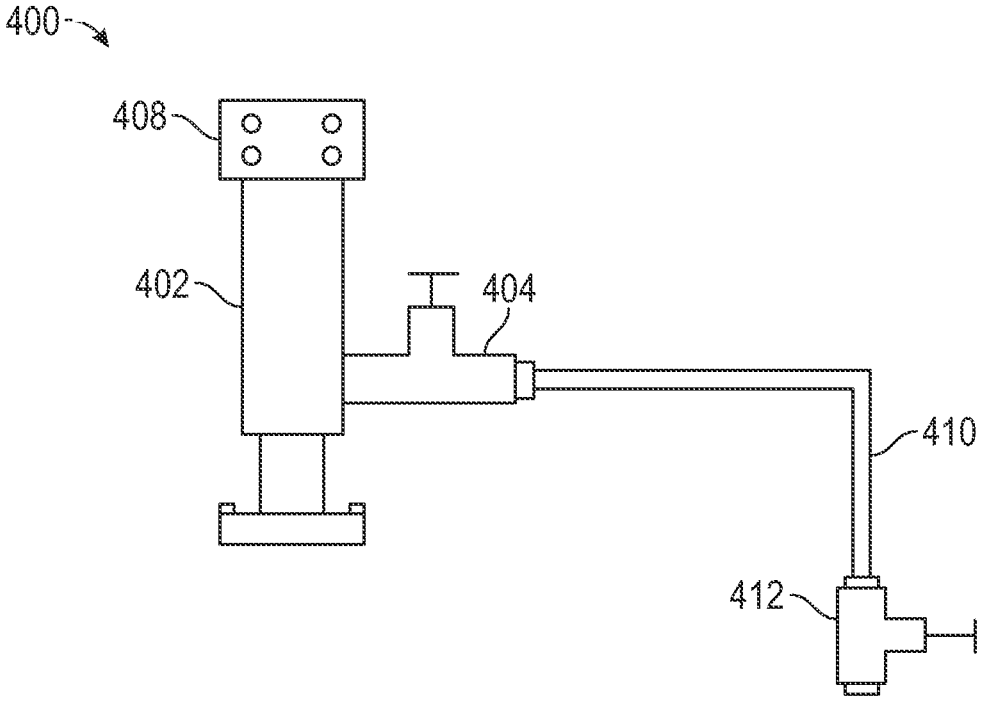

FIGS. 4A-4C show a sensor deployment capsule (400) coupled to a Christmas tree (109) in accordance with one or more embodiments. Specifically, FIGS. 4A-4C illustrate a non-spring-loaded model of a sensor deployment capsule (400). The sensor deployment capsule (400) may be used for high-pressure oil wells.

Turning to FIG. 4A, the sensor deployment capsule (400) may be coupled to the Christmas tree (109). The Christmas tree (109) includes a master valve (e.g., lower master valve (114) and/or upper master valve (113)) capable of opening and closing. The sensor deployment capsule (400) includes a cylindrical housing (402), a drain valve (404), and a pressure gauge (406). The cylindrical housing (402) may be made of a material that withstands temperature variations, corrosive fluids, and abrasive materials, such as those found in well environments. The cylindrical housing (402) may be a metal housing. The material of the cylindrical housing (402) may increase durability and reliability of the sensor deployment capsule (400) during deployment and data acquisition. The cylindrical housing (402) includes a removable cap screw (408). The removable cap screw (408) may be removed and screwed back on for inserting and retrieving a welltracker (200) from the sensor deployment capsule (400). The removable cap screw (408) allows for inserting the welltracker (200) as described in FIGS. 2 and 3, in the cylindrical housing (402). The welltracker (200) is stored in the cylindrical housing (402) when the master valve (114) of the Christmas tree (109) is closed. Closing the master valve (114) allows for storing the welltracker (200) in the sensor deployment capsule (400). When the master valve (114) is opened, the welltracker (200) is deployed through the Christmas tree (109) and into a well (e.g., wellbore (103)).

As the welltracker (200) descends into the wellbore (103), pressure within the wellbore (103) increases. The drain valve (404) releases excess pressure to prevent damage or failure of the sensor deployment capsule (400) due to high pressure differentials. The drain valve (404) is coupled to the cylindrical housing (402) and a pressure transfer line (410). The pressure transfer line (410) may be any line connecting the drain valve (404) to the Christmas tree (109). The drain valve (404) bleeds off any trapped pressure inside the cylindrical housing (402) through the pressure transfer line (410).

Trapped pressure may occur from retrieval of the welltracker (200) back into the cylindrical housing (402). The trapped pressure may then be transferred back to a well flowline or trunk line. Any pressure build up may potentially affect wellbore (103) integrity. Once the trapped pressure is bled off, the welltracker (200) may be safely retrieved from the sensor deployment capsule (400) by removing the removable cap screw (408). The pressure gauge (406) is coupled to the removable cap screw (408). The pressure gauge (406) may be any gauge capable of controlling pressure in the sensor deployment capsule (400). The pressure gauge (406) may control pressure, possibly in conjunction with other valves or mechanisms. The pressure gauge (406) may serve critical functions including monitoring and potentially controlling internal pressure of the sensor deployment capsule (400), ensuring safe retrieval of the welltracker (200), and maintaining integrity of the wellbore (103) and associated equipment. Any significant pressure buildup inside the cylindrical housing (402) may pose risks to the wellbore (103) and personnel safety. The pressure gauge (406) may monitor and manage the pressure buildup to prevent equipment damage, wellbore (103) collapse, harm to personnel and environment, and other catastrophic failures. The pressure gauge (406) may provide real-time data for internal pressure of the cylindrical housing (402). The pressure gauge (406) may be strategically placed in a location for accessibility allowing quick pressure checks before opening the sensor deployment capsule (400).

The pressure transfer line (410) may include a safety valve (412) between the Christmas tree (109) and the drain valve (404). The safety valve (412) may be a relief valve to manage trapped pressure or allow excess pressure to escape to prevent damage or failure of the sensor deployment capsule (400) due to high pressure differentials. The safety valve (412) may prevent abrupt changes in pressure that can potentially disrupt the retrieval process of the welltracker (200). FIGS. 4B and 4C show the sensor deployment capsule (400) disconnected from the Christmas tree (109). The sensor deployment capsule (400) may be removed from the Christmas tree (109) to ensure safety and prevent well effluents from escaping through valves. In some embodiments, if the removable cap screw (408) is removed, the Christmas tree (109) remains exposed to the atmosphere for a prolonged period. In such cases, damage or vulnerabilities in valves may lead to well effluents escaping, leading to potential leaks and environmental pollution.

Figure 5A:
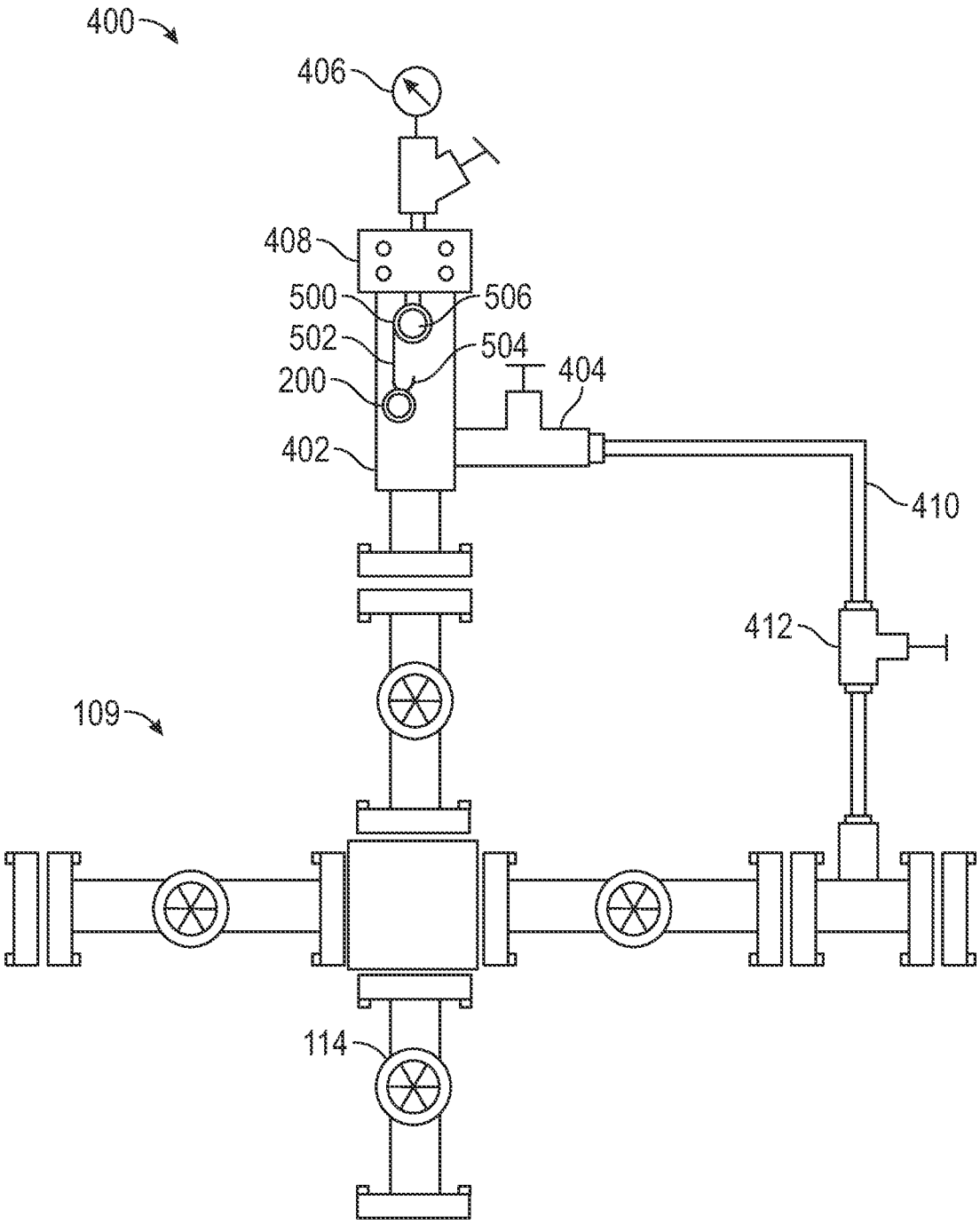
FIGS. 5A-5C show a sensor deployment capsule used in conjunction with FIGS. 1-3 in accordance with one or more embodiments.
Figure 5B:
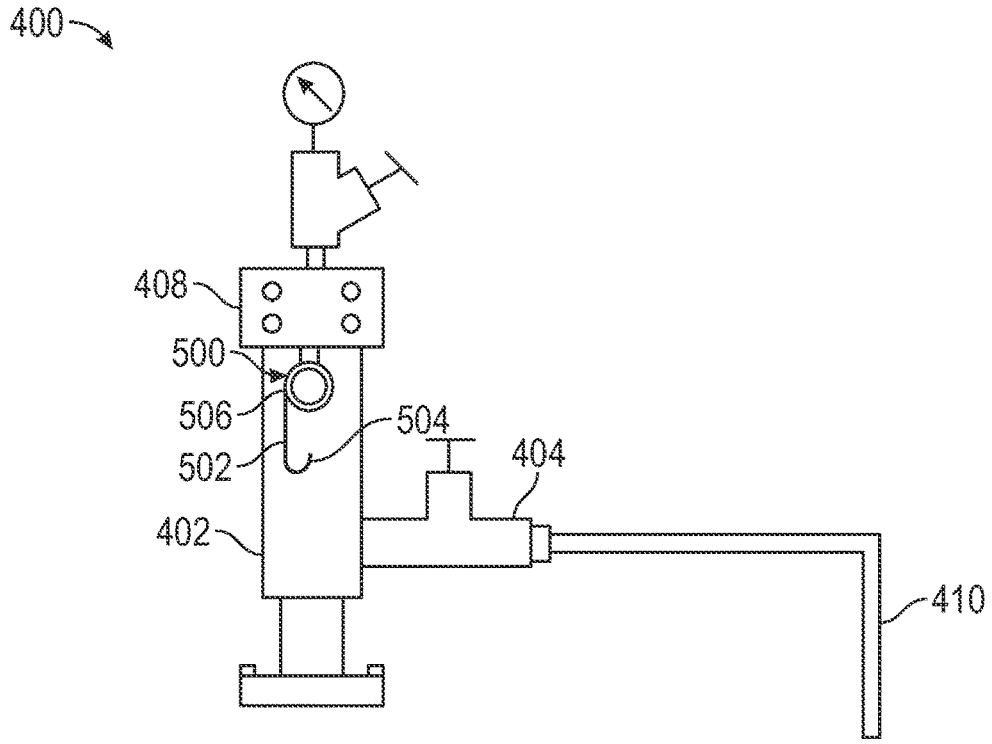
Figure 5C:
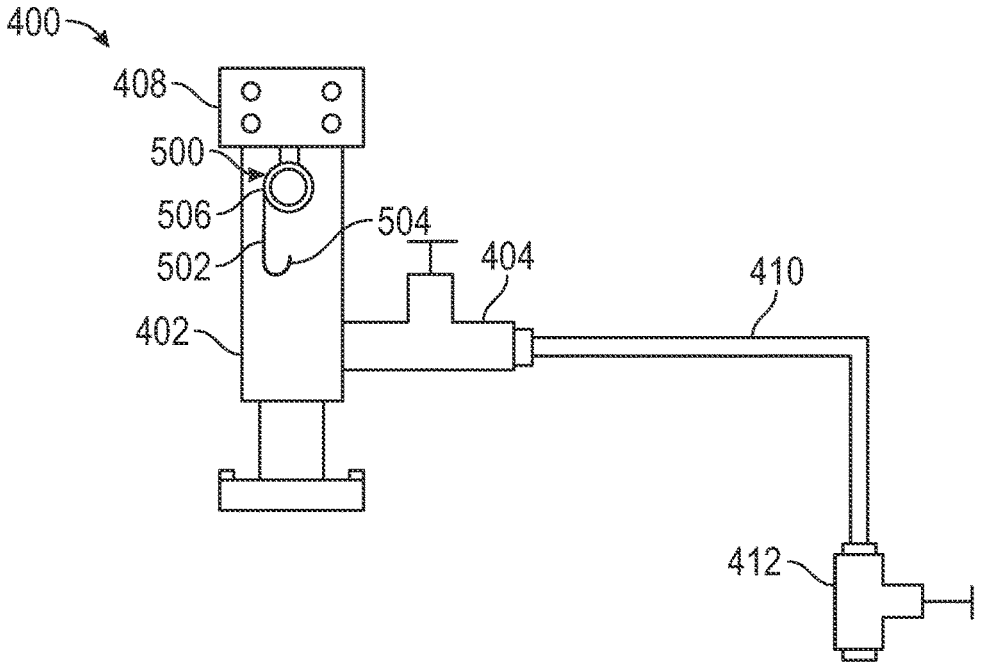

FIGS. 5A-5C show a sensor deployment capsule (400) coupled to a Christmas tree (109) in accordance with one or more embodiments. Specifically, FIGS. 5A-5C illustrates a spring-loaded model of the sensor deployment capsule (400). The sensor deployment capsule (400) described in FIGS. 4A-4C may include a sensor pulling device (500). The sensor pulling device (500) may be disposed in the cylindrical housing (402). The sensor deployment capsule (400) with the sensor pulling device (500) may be used in low pressure oil and gas wells. The sensor pulling device (500) may include a spring (502). The spring (502) may be connected using a hook (504) to an eye (255) on the welltracker (200) as described in FIGS. 2 and 3. The spring (502) may have extending and retracting capability using a hook roller (506). The hook roller (506) may be attached to the removable cap screw (408) with the spring (502) and hook (504) attached. The welltracker (200) may be attached to the hook (504) through the eye (255).

For example, the spring (502) may extend with the welltracker (200) attached and retract once the dissolvable weight (240) is dissolved/removed. The spring (502) may retract with the support of well fluid pressure. The well fluid pressure may be weak or strong. In some embodiments, the spring (502) allows the welltracker (200) to overcome limited well fluid pressure to help in successful retrieval of the welltracker (200). The spring (502) may provide the necessary force to assist the welltracker (200) in returning to the sensor deployment capsule (400) when the dissolvable weight (240) is dissolved. The spring (502) may be preloaded in the sensor deployment capsule (400) to securely hold the welltracker (200) in place during descent. The spring (502) may properly position the welltracker (200) within the sensor deployment capsule (400) and as it travels through the wellbore (103). FIGS. 5B and 5C show the sensor deployment capsule (400) with the sensor pulling device (500) disconnected from the Christmas tree (109).

Figure 6:
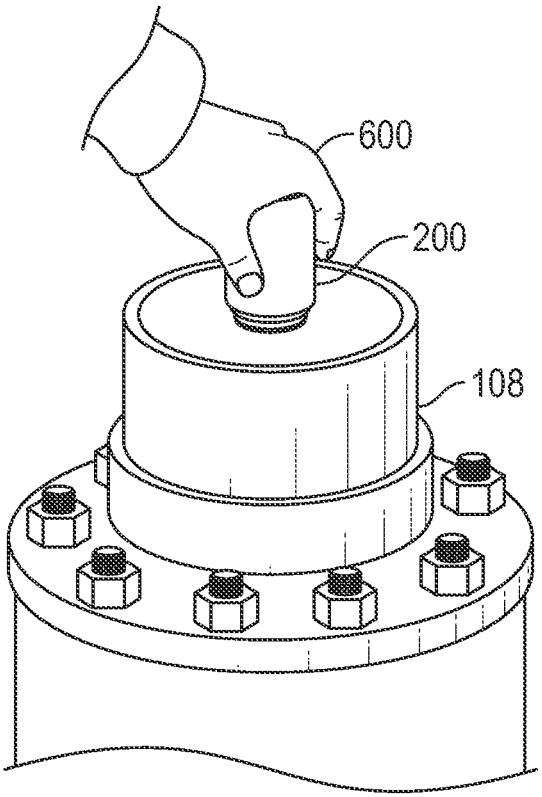
FIGS. 6 and 7 show a conventional wellhead in accordance with one or more embodiments.
Figure 7:
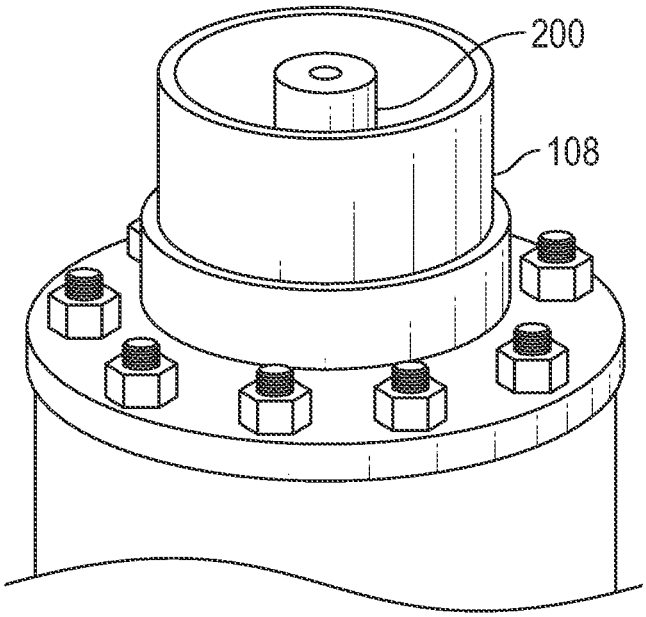

FIGS. 6 and 7 show a conventional wellhead (108) in accordance with one or more embodiments. Specifically, FIG. 6 illustrates a hand (600) from a user deploying a sensor or welltracker (200) into a well (103). For example, dropping the welltracker (200) into the wellhead (108) is the current conventional means for sensor deployment into a well (103). The welltracker (200) may be dropped in the well (103) using a gravity drop method. The gravity drop method may be used in free-flowing conditions or when the welltracker (200) is designed to sink in well fluid. Gravity drop involves simply releasing the welltracker (200) into the well (103) from surface. The welltracker (200) descends under force of gravity aided by well fluid flow if present. The welltracker (200) may be dropped into the well (103) by alternative methods including mechanical deployment, pumping methods, and hydraulic release. The choice of dropping method may depend on various factors, such as wellbore conditions, well completion design, operation requirements, and specific characteristics of the welltracker (200). The choice of dropping method is dependent on ensuring the welltracker (200) reaches the desired depth accurately and safely for effective data acquisition and surveillance in the well (103).

Mechanical deployment involves using mechanical tools or devices to lower the welltracker (200) into the well (103). Mechanical tools may include wireline systems, slickline tools, coiled tubing, or other specialized deployment equipment. The welltracker (200) may be attached to the mechanical tool. The mechanical tool may control the descent into the wellbore (103). Pumping methods include using fluid circulation. The welltracker (200) may be placed in a carrier fluid, such as drilling mud or completion fluid, and pumped down the wellbore (103). The fluid carries the welltracker (200) to the desired depth. In such cases, once the target depth is reached, the carrier fluid is displaced and the welltracker (200) settles in position. Hydraulic release systems utilize hydraulic pressure to release the welltracker (200) at the desired depth. The welltracker (200) is initially held in a release mechanism or carrier tool and is then deployed into the well (103). Once the tool reaches the target depth, hydraulic pressure is applied to activate the release mechanism and the welltracker (200) detaches and freely floats in the well (103).

FIG. 7 illustrates the welltracker (200) in the wellhead (108) when returned back to surface. The welltracker (200) may return to surface using different mechanisms dependent on the design and well conditions. A few methods for returning to surface include buoyancy, dissolvable weight, and retrieval tools. Buoyancy involves designing the welltracker (200) with buoyant properties so that the welltracker (200) naturally rises to the surface once its deployment task is complete. Incorporating lightweight material or air-filled compartments within the structure of the welltracker (200) may be used for buoyancy methods. As fluids circulate or flow, the buoyant force causes the welltracker (200) to ascend through the wellbore (103) and eventually reach surface. Dissolvable weight methods involve a dissolvable weight attached to the welltracker (200) as described in FIGS. 2 and 3. The dissolvable weight may be designed to dissolve in well fluid over time, thereby reducing the overall weight of the welltracker (200). The dissolvable weight method may control ascent based on dissolution rate of the weighted material. The sensor deployment capsule (400) described in FIGS. 4A-4C use the buoyancy method and/or dissolvable weight method. Buoyancy methods may be used when well fluid provide sufficient pressure to lift the welltracker (200) to the sensor deployment capsule (400).

Retrieval tool method may be used to actively retrieve the welltracker (200) from the well (103), such as the spring (502) mechanism in the sensor pulling device (500) described in FIGS. 5A-5C. A retrieval tool may be deployed downhole to engage with the welltracker (200) and facilitate upward movement. Retrieval tool methods are particularly useful when the welltracker (200) is unable to naturally return to surface to wellbore obstructions of other factors.

In one or more embodiments, a welltracker (200) undergoes pre-job checks during diel deployment in a well (103). The well (103) may be a land rigless well. The pre-job checks may be conducted to ensure proper functioning and readiness of the welltracker (200) and accuracy of data acquisition to prevent operation issues. Possible pre-job checks include visual inspection, battery check, sensor calibration, communication test, pressure test, functionality test, deployment plan review, and safety checks. Visual inspection includes conducting a visual inspection of the welltracker (200) to check for any physical damage, such as cracks or leaks. The visual inspection may ensure all components are intact and properly connected. Battery check involves verifying that the battery level of the welltracker (200) has sufficient power for the duration of deployment. If the battery is low, the internal battery (215) may be replaced or charged before deployment.

Sensor calibration involves checking the calibration of the sensors (225) within the welltracker (200). Sensor calibration may include comparting sensor readings with known reference values or following calibration procedures recommended by the manufacturer. Communication tests involve verifying communication capabilities of the welltracker (200). Communication tests include establishing a connection with the surface equipment or data acquisition system for transmitting data reliably. A communication test may be conducted to confirm data transmission is functioning correctly. Pressure tests may include subjecting the welltracker (200) to simulated downhole pressures and verifying integrity maintenance. Functionality tests involve deploying the welltracker (200) in a controlled environment or mock wellbore (103) and monitoring data acquisition. Functionality test may verify that the sensors (225) are collecting accurate and reliable data. Deployment plan review involves reviewing and confirming that deployment procedure aligns with specific requirements of the land rigless well using all necessary equipment and tools prepared. Safety checks involve conducting checks to ensure all personnel involved in the deployment are trained and equipped with necessary personal protective equipment. Safety checks further include verifying safety protocols and procedures are in place and understood by all personnel.

Figure 8:
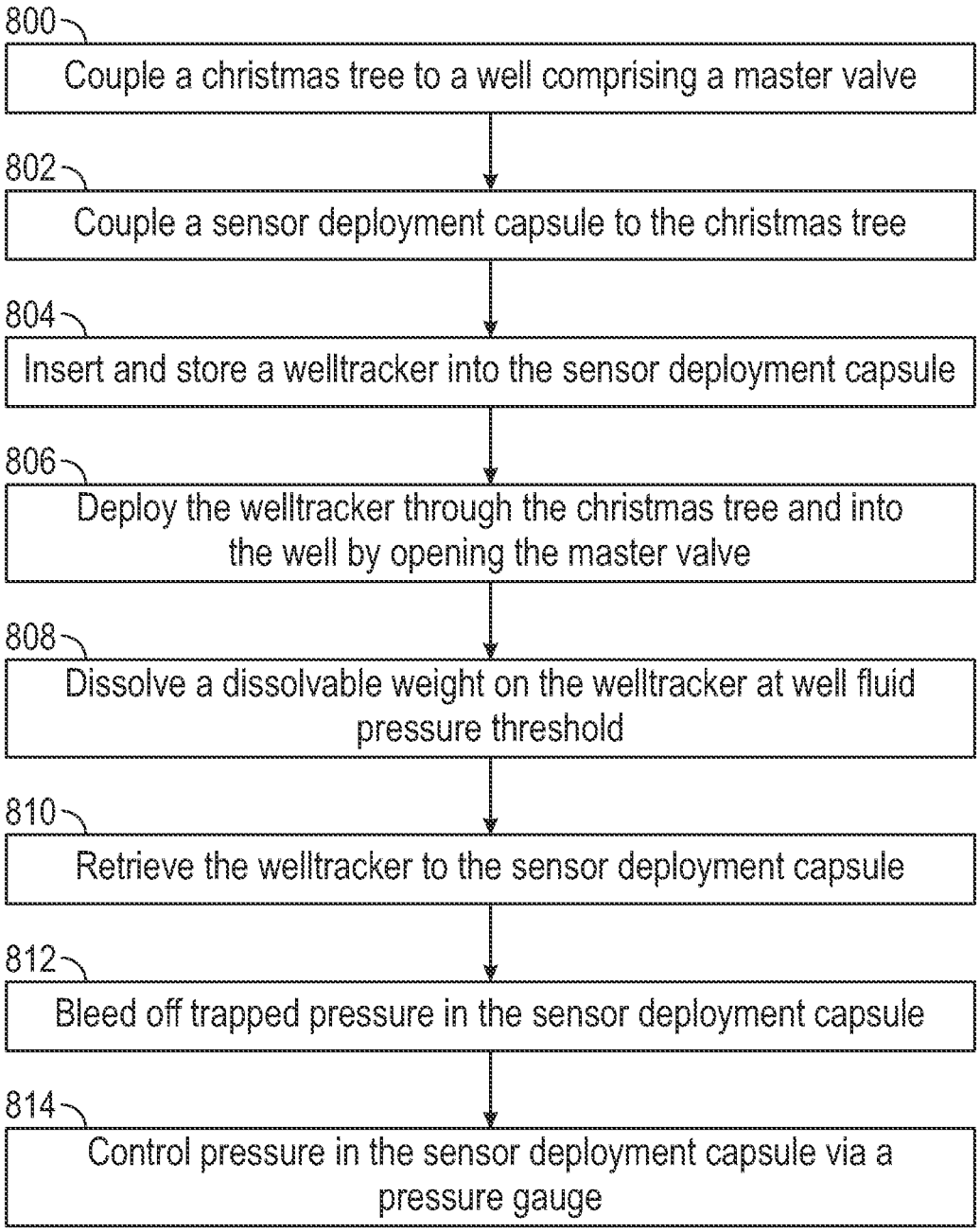
FIG. 8 shows a flowchart in accordance with one or more embodiments.

FIG. 8 shows a flowchart in accordance with one or more embodiments. Specifically, FIG. 8 describes a method for deploying and retrieving a welltracker in a well. The well may include any completion design including vertical, deviated, or varied orientation. One or more blocks in FIG. 8 may be performed by one or more components (e.g., sensor deployment capsule (400)) as described in FIGS. 1-7. While the various blocks in FIG. 8 are presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

In Block 800, a Christmas tree is coupled to a well comprising a master valve. The master valve is designed to open and close. The Christmas tree may be coupled to the wellhead of the well. In Block 802, a sensor deployment capsule is coupled to the Christmas tree. The sensor deployment capsule includes a cylindrical housing, a drain valve, a pressure transfer line, and a pressure gauge. The cylindrical housing includes a removable cap screw. The drain valve is coupled to the cylindrical housing and the pressure transfer line. The pressure gauge is coupled to the removable cap screw. The cylindrical housing may be made of a material designed to withstand temperature variations, corrosive fluids, and abrasive materials in the environment of the well. In some embodiments, a sensor pulling device may be installed in the sensor deployment capsule. The sensor pulling device may include a spring in the cylindrical housing.

Initially, the master valve is closed. In Block 804, a welltracker is inserted and stored in the sensor deployment capsule. The welltracker is inserted and stored specifically in the cylindrical housing by removing the removable cap screw. The welltracker may be connected to the spring of the sensor pulling device using a hook in an eye on the welltracker. In some embodiments, the master valve remains closed until the welltracker reaches the base of the sensor deployment capsule. In Block 806, the welltracker is deployed through the Christmas tree and into the well by opening the master valve. For example, once the desired depth of the welltracker is reached in the sensor deployment capsule, the master valve may be opened to deploy the welltracker. The welltracker descends naturally by its own weight aided by well fluid pressure support. As the welltracker descends into the well, well data is measured via a sensor in the welltracker. The sensor may be operated by an internal battery in the welltracker. Well data or parameter data may include pressure data, temperature data, and triaxial magnetic field data. Well data may be collected using the welltracker as the welltracker travels in the well.

A dissolvable weight may be attached magnetically to the welltracker. The dissolvable weight may navigate the welltracker to a target well depth. In Block 808, a dissolvable weight on the welltracker is dissolved at a well fluid pressure threshold. Once the dissolvable weight is dissolved, the assistance of well fluid pressure may allow the welltracker to be carried freely to surface for return to the sensor deployment capsule. In Block 810, the welltracker is retrieved to the sensor deployment capsule. The welltracker is retrieved into the cylindrical housing when the dissolvable weight is dissolved. In some embodiments when a sensor pulling device is installed, retrieving the welltracker includes retracting the spring when the dissolvable weight is dissolved. Retrieving the welltracker may include removing the removable cap screw from the sensor deployment capsule.

In one or more embodiments, upon the return of the welltracker to the sensor deployment capsule, pressure may be trapped within the sensor deployment capsule. In Block 812, trapped pressure in the sensor deployment capsule is bled off. The trapped pressure caused from the retrieval of the welltracker in the cylindrical housing is bled off using the drain valve. The trapped pressure bleeds through the pressure transfer line. Bleeding off the trapped pressure from the sensor deployment capsule ensures safe removal of the sensor deployment capsule from the Christmas tree or wellhead. The sensor deployment capsule may be disconnected from the Christmas tree. The welltracker may be retrieved from the sensor deployment capsule for collecting and downloading well data for further analysis and interpretation. In Block 814, pressure inside the sensor deployment capsule is controlled using a pressure gauge on the sensor deployment capsule.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system for deploying and retrieving a welltracker in a well comprising:

a Christmas tree coupled to the well comprising a master valve configured to open and close; and a sensor deployment capsule coupled to the Christmas tree, the sensor deployment capsule comprising:

a cylindrical housing comprising a removable cap screw for inserting the welltracker in the cylindrical housing, the cylindrical housing configured to store the welltracker when the master valve is closed, wherein the master valve is configured to deploy the welltracker through the Christmas tree and into the well when open, wherein the welltracker comprises a dissolvable weight configured to dissolve at a well fluid pressure threshold for retrieving the welltracker to the cylindrical housing;

a drain valve coupled to the cylindrical housing configured to bleed off trapped pressure in the cylindrical housing from retrieval of the welltracker through a pressure transfer line coupled to the drain valve; and a pressure gauge coupled to the removable cap screw configured to control pressure in the sensor deployment capsule.

2. The system of claim 1, further comprising:

a sensor pulling device disposed in the cylindrical housing comprising a spring, wherein the welltracker comprises an eye for connecting the spring to the welltracker via a hook, and wherein the sensor pulling device is configured to retrieve the welltracker using the spring when the dissolvable weight is dissolved.

3. The system of claim 1, further comprising:

wherein the welltracker comprises a sensor configured to measure well data, and wherein well data comprises pressure data, temperature data, and triaxial magnetic field data, wherein the welltracker is configured to collect the well data as the welltracker travels in the well.

4. The system of claim 1, wherein the cylindrical housing is made of a material configured to withstand temperature variations, corrosive fluids, and abrasive materials in an environment of the well.

5. The system of claim 3, further comprising:

wherein the welltracker comprises an internal battery configured to operate the sensor.

6. The system of claim 1, wherein the dissolvable weight is magnetically attached to the welltracker.

7. The system of claim 1, wherein the dissolvable weight is configured to navigate the welltracker to a target well depth.

8. The system of claim 1, wherein the well comprises a completion design of vertical, deviated, or varied orientation.

9. The system of claim 1, wherein the removable cap screw is configured to be removed for retrieving the welltracker from the sensor deployment capsule.

10. The system of claim 1, wherein the sensor deployment capsule is configured to be disconnected from the Christmas tree.

11. A method for deploying and retrieving a welltracker in a well, the method comprising:

coupling a Christmas tree to the well comprising a master valve configured to open and close;

coupling a sensor deployment capsule to the Christmas tree, the sensor deployment capsule comprising:

a cylindrical housing comprising a removable cap screw;

a drain valve coupled to the cylindrical housing and a pressure transfer line; and a pressure gauge coupled to the removable cap screw;

inserting and storing the welltracker into the cylindrical housing via the removable cap screw, wherein storing the welltracker comprises closing the master valve;

deploying the welltracker through the Christmas tree and into the well by opening the master valve;

dissolving a dissolvable weight on the welltracker at a well fluid pressure threshold;

retrieving the welltracker to the cylindrical housing when the dissolvable weight is dissolved;

bleeding off trapped pressure in the cylindrical housing from retrieval, via the drain valve, through the pressure transfer line; and controlling pressure in the sensor deployment capsule via the pressure gauge.

12. The method of claim 11, further comprising:

installing a sensor pulling device comprising a spring in the cylindrical housing, and wherein inserting the welltracker comprises connecting the spring to an eye on the welltracker via a hook, wherein retrieving the welltracker comprises retracting the spring, via the sensor pulling device, when the dissolvable weight is dissolved.

13. The method of claim 11, further comprising:

measuring well data, via a sensor in the welltracker, wherein well data comprises pressure data, temperature data, and triaxial magnetic field data; and collecting well data, via the welltracker, as the welltracker travels in the well.

14. The method of claim 11, further comprising:

wherein the cylindrical housing is made of a material configured to withstand temperature variations, corrosive fluids, and abrasive materials in an environment of the well.

15. The method of claim 13, further comprising:

operating the sensor via an internal battery in the welltracker.

16. The method of claim 11, further comprising:

attaching the dissolvable weight magnetically to the welltracker.

17. The method of claim 11, further comprising:

navigating the welltracker to a target well depth, via the dissolvable weight.

18. The method of claim 11, wherein the well comprises a completion design of vertical, deviated, or varied orientation.

19. The method of claim 11, wherein retrieving the welltracker comprises removing the removable cap screw from the sensor deployment capsule.

20. The method of claim 11, further comprising:

disconnecting the sensor deployment capsule from the Christmas tree.

* * * * *